US007251866B2

(12) United States Patent
Himi

(10) Patent No.: US 7,251,866 B2
(45) Date of Patent: Aug. 7, 2007

(54) END STOP FOR SLIDE FASTENER

(75) Inventor: Naoyuki Himi, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 11/016,646

(22) Filed: Dec. 16, 2004

(65) Prior Publication Data

US 2005/0132542 A1 Jun. 23, 2005

(30) Foreign Application Priority Data

Dec. 19, 2003 (JP) ..... 2003-423416

(51) Int. Cl.
*A44B 19/36* (2006.01)

(52) U.S. Cl. ..... 24/435; 24/436

(58) Field of Classification Search ..... 24/433–436
See application file for complete search history.

(56) References Cited

U.S. PATENT DOCUMENTS 1,794,139 A * 2/1931 Blair ..... 24/419
2,347,426 A * 4/1944 Marinsky ..... 24/410
2,398,592 A * 4/1946 Morin ..... 24/410
2,423,202 A * 7/1947 Morin ..... 24/404
2,819,504 A * 1/1958 Morin ..... 24/435
3,067,476 A * 12/1962 Cromberg et al. ..... 24/391
4,091,509 A * 5/1978 MacFee ..... 24/391

FOREIGN PATENT DOCUMENTS

CN 01254568.6 9/2002
JP 56-51773 12/1981
WO WO 2004000062 A1 * 12/2003

* cited by examiner

*Primary Examiner*—James R. Brittain
(74) *Attorney, Agent, or Firm*—Everest Intellectual Property Law Group; Michael S. Leonard

(57) ABSTRACT

An end stop which does not induce separation or deterioration in its mounting portion by fusing part thereof. A linear fastener element row formed of synthetic resin is mounted on a side edge of a fastener tape, and a rod-like body of synthetic resin is inserted into the interior of plural fastener elements located at a final end of the element row. A fused portion is proved by welding only a side of an outer end portion of the rod-like body while a non-fused portion is formed without welding a side of an inner end portion, so the end stop as a top or bottom end stop is produced. The non-fused portion absorbs an impact when a slider collides with the end stop and induces no deterioration in sewing yarn and such. The fused portion integrates the end stop with fastener elements firmly, so a rigid structured end stop is completed.

10 Claims, 8 Drawing Sheets

END STOP FOR SLIDE FASTENER

BACKGROUND OF THE INVENTION

1. Field of the Invention

The present invention relates to a top end stop and bottom end stop for a slide fastener in which coil type, or zigzag type linear fastener elements made of synthetic resin are mounted on a side edge of a fastener tape and a hidden type slide fastener.

2. Description of Related Art

Conventionally, various types of top end stops and bottom end stops in the coil type or zigzag type linear slide fastener and hidden type slide fastener made of synthetic resin have been proposed. According to Japanese Utility Model Publication No. 56-51773, a synthetic resin piece 114 having a circular section is formed in the back surface of the heads 120 of the tape 107 side of plural elements at a final end of the linear fastener element row 103, such that it can be fused as shown in FIG. 10 and an end portion of the synthetic resin piece 114 located at a final end of the element row 103 is bent to the surface so as to produce a bent portion 119. The end face of the bent portion 119 is formed lower than the surface of the elements and then, the bent portion 119 is fused with a coupling face formed in a curved state on a side face of the element head 120 at the final end of the element row 103.

Further, according to Republic of China Utility Model Registration No. 125468.6, it has been known that as shown in FIG. 11, a filament 214 of a specified length is inserted into a coil type linear fastener element row 203 made of synthetic resin and the inserted filament 214 and the fastener elements are welded together with ultrasonic wave so as to form a bottom end stop 211.

In the end stop shown in FIG. 10, a synthetic resin piece 114 is fused to the bottom face of a head of the linear fastener element row 113 by ultrasonic processing with a pressure and the end portion thereof is bent to the surface side of the element and fused to the side face of the element head 120. Because the fusing process for the synthetic resin is very complicated, this cannot be produced at a cheap price. Further, because the synthetic resin piece 114 is fused with the surface of the elements, there is a fear that it may be separated during usage.

Because in the bottom end stop 211 shown in FIG. 11, a filament 214 inserted into a linear fastener element row 203 of synthetic resin is fused with the fastener element throughout the entire length, a sewing yarn which sews the fastener elements at the bottom end stop is deteriorated due to ultrasonic welding processing, so that the sewing yarn is cut out because of a load accompanying an opening/closing of a slider fastener, thereby the bottom end stop being incapable of bearing a long term usage.

The present invention has been accomplished in views of the above-described problem and therefore, a prominent object of the present invention is to provide an end stop for a slide fastener, which serves as a top end stop and bottom end stop for preventing a slider from slipping out of an ordinary type or hidden type slide fastener equipped with a linear fastener element row of synthetic resin, the top end stop and bottom end stop being produced by, after a rod-like body of synthetic resin is inserted into liner fastener elements, fusing only an end portion thereof, so that these end stops are never separated or affected by deterioration, thereby ensuring a rigid structure and a cheap price.

Another object of the present invention is to provide an end stop for a slide fastener which can be completed as a rigid structure by specifying a range of a portion to be fused together in the rod-like body.

Still another object of the present invention is to provide an end stop for a slide fastener which can be produced as a top end stop easily by disposing the rod-like body of synthetic resin in the linear fastener element row in an ideal form.

A further object of the present invention is to provide an end stop for a slide fastener which can be produced as a bottom end stop easily by disposing the rod-like body of synthetic resin in the linear fastener element row in an ideal form.

A still further object of the present invention is to provide an end stop for a slide fastener which is sewed on a side edge of the linear fastener element row so that it can be employed effectively as an ordinary type slide fastener or a hidden type slide fastener.

A yet still further object of the present invention is to provide an end stop for a slide fastener which can be employed effectively as an end stop for a coil type slide fastener formed of coil type fastener elements.

A further object of the present invention is to provide an end stop for a slide fastener which can be employed as an end stop for a zigzag type slide fastener formed of zigzag type fastener elements.

SUMMARY OF THE INVENTION

To achieve the above-described object, according to a main aspect of the present invention, there is provided an end stop for a slide fastener being characterized in that a linear fastener element row of synthetic resin is mounted on a side edge of a fastener tape; a rod-like body of synthetic resin is inserted into a coupling space portion located in an inside of coupling heads in plural fastener elements located at an end of the fastener element row; a fused portion is provided by fusing the several fastener elements of the plural fastener elements in which the rod-like body is inserted with the rod-like body; and a non-fused portion is formed without fusing the fastener elements of the plural fastener elements in which the rod-like body is inserted except the fastener elements fused with the rod-like body as the fused portion with the rod-like body so as to form the end stop.

As a consequence, because the fused portion is formed in the end stop, the end stop is fused integrally and hence a rigid end stop can be completed. Further, because the non-fused portion is formed in the end stop, the sewing yarn of the inner end portion of the end stop is not subjected to deterioration by heat generated upon ultrasonic wave welding, so that that sewing yarn is never cut out even due to concentration of stress generated when the slide fastener is opened or closed. Thus, this end stop can bear a long term use thereby ensuring a good quality and contributing to expansion of sales.

Preferably, the fused portion is provided on an outer end portion of the rod-like body.

Preferably, a length of the fused portion in a longitudinal direction of the rod-like body is in a range of half or less of the length of the rod-like body.

Preferably, a first fused portion is provided on the outer end portion of the rod-like body, a second fused portion is provided on an inner end portion of the rod-like body, and the non-fused portion is provided between the first fused portion and the second fused portion.

Preferably, a length of the first fused portion in a longitudinal direction of the rod-like body is longer than the length of the second fused portion.

Preferably, a length of the non-fused portion in a longitudinal direction of the rod-like body is in a range of less than a sum of the length of the first fused portion and the length of the second fused portion.

Preferably, a length of the first fused portion in a longitudinal direction of the rod-like body is longer than the length of the second fused portion and the length of the non-fused portion.

Consequently, the second fused portion prevents the inner end portion of the rod-like body from escaping from the inside of the coil type fastener elements at the time when the slider moves to the location where the slider contacts with the bottom end stop, right and left coil type fastener elements are separated, and the coil type fastener elements in the inner end portion side of the bottom end stop are pushed and opened in the right and left directions.

Also, due to providing the non-fused portion in the bottom end stop, the rod-like body is not fused with the coil type fastener elements too tightly, and the fused rod-like body and the coil type fastener elements do not become fragile and are not damaged. Further, since the bottom end stop does not become rigid, even if the slider moves toward the bottom end stop and butts the bottom end stop, the non-fused portion bends slightly and changes its shape so that it alleviates the impact strength and prevents the damage of bottom end stop.

Preferably, the rod-like body is inserted into the linear fastener element row in a separated state so as to form a top end stop. Consequently, by inserting the rod-like body into the fastener stringer in which the linear fastener elements are in the separated state, the top end stop can be produced easily.

Preferably, the rod-like body is inserted into the linear fastener element row in a coupled state so as to form a bottom end stop. Consequently, by adopting the rod-like body to the fastener chain in which the linear fastener elements are in a coupled state, the bottom end stop can be produced easily.

Preferably, the linear fastener element row is disposed on the side edge of the fastener tape and sewed with a sewing yarn. Consequently, a good quality end stop can be applied to an ordinary type slide fastener and a hidden type slide fastener formed of the linear fastener element row easily.

Preferably, the linear fastener element row is formed of coil type fastener elements. Consequently, a good quality end stop can be applied to a slide fastener formed of the coil type fastener elements easily.

Preferably, the linear fastener element row is formed of zigzag type fastener elements. Consequently, a good quality end stop can be applied to a slide fastener formed of the zigzag type fastener elements easily. The effects which the present invention exerts are considerably great.

DESCRIPTION OF THE PREFERRED EMBODIMENTS

Hereinafter, preferred embodiments of the present invention will be described in detail with reference to the accompanying drawings.

Figure 1:
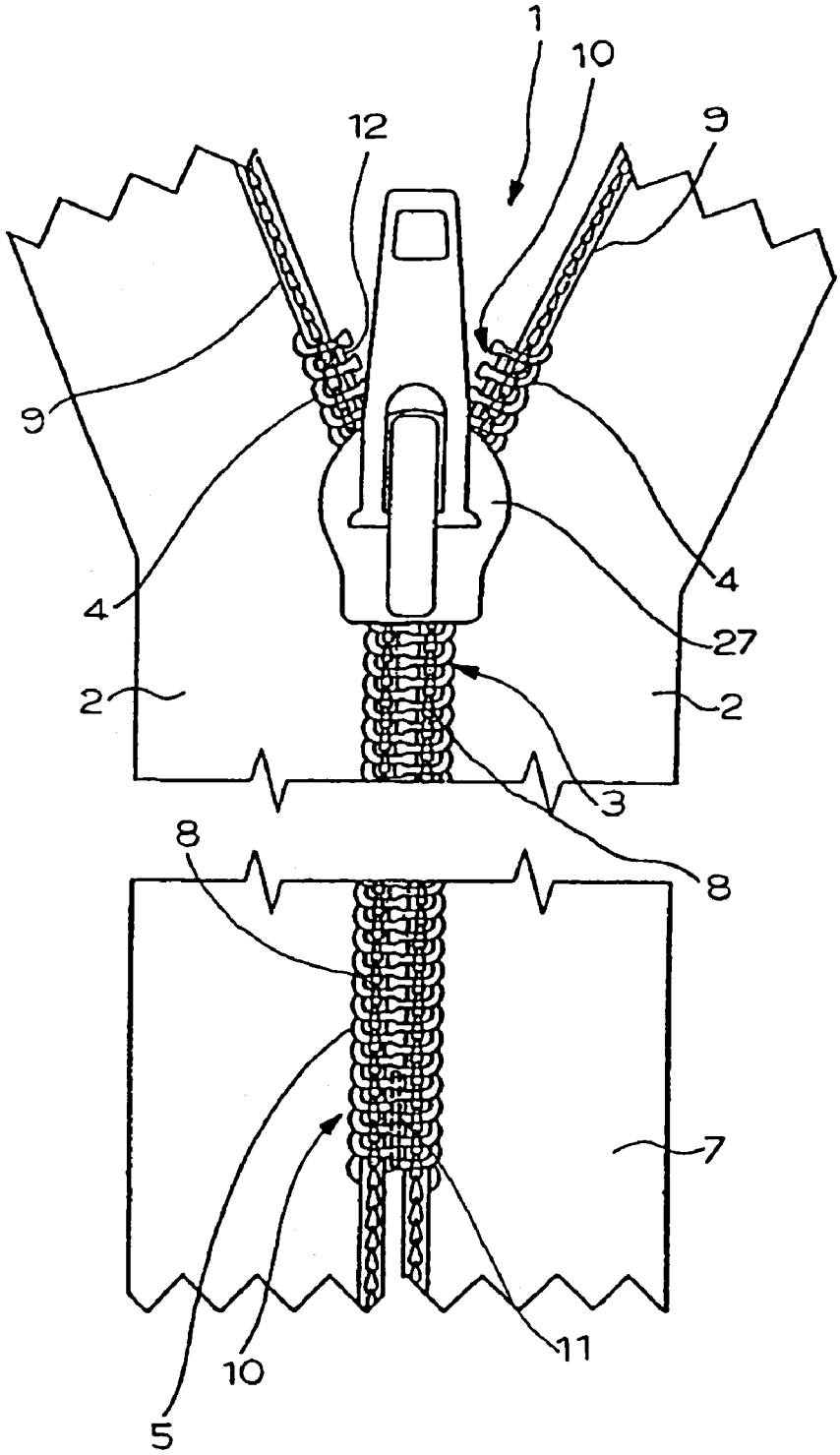
FIG. 1 is a front view of an ordinary type slide fastener.
Figure 2:
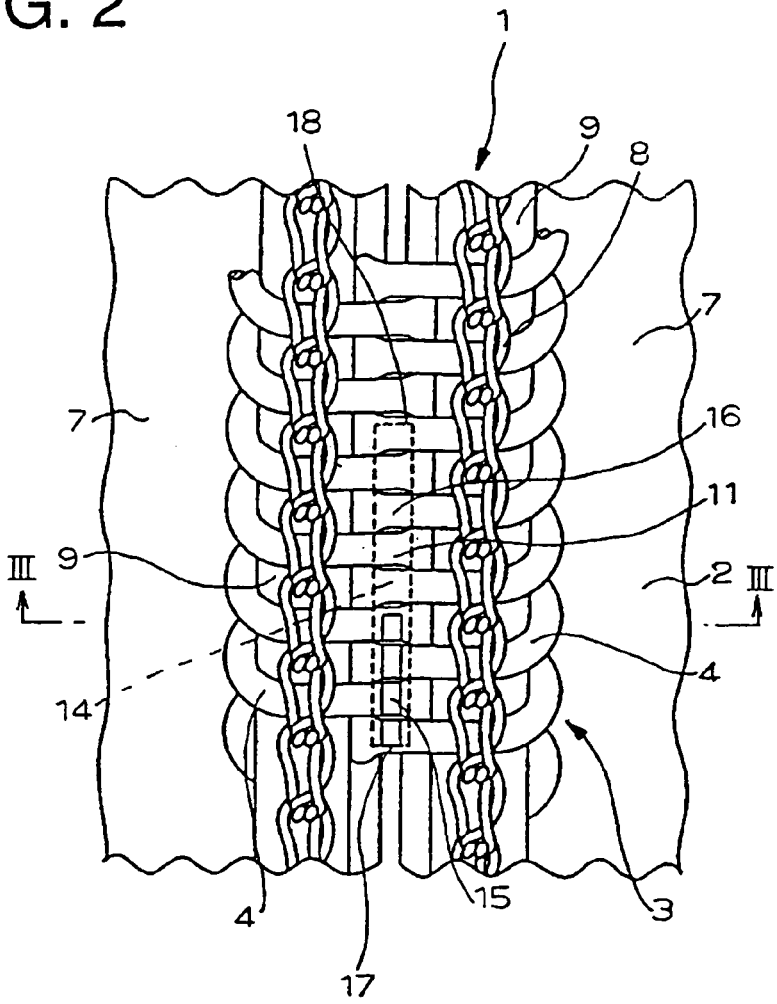
FIG. 2 is a front view of a bottom end stop in the same slide fastener.
Figure 3:
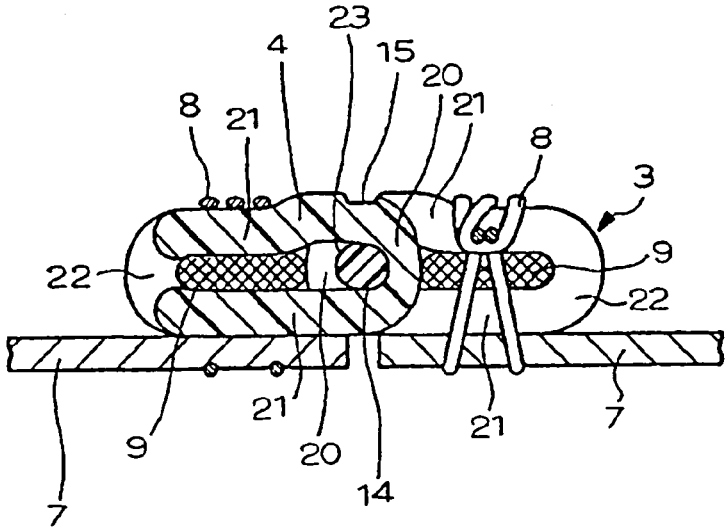
FIG. 3 is a sectional view of the bottom end stop taken along the line III-III of FIG. 2 in the same slide fastener.

An end stop for a slide fastener of the present invention is an end stop comprising a top end stop 12 and a bottom end stop 11, which are to be mounted on a top end and a bottom end respectively of a slide fastener as shown in FIG. 1. For the slide fastener, coil type fastener elements 5 are formed by winding a mono-filament made of polyamide or polyester in the form of a coil, or zigzag type fastener elements 6 are formed by bending a mono-filament in a zigzag shape so as to form a linear fastener element row 3 respectively. This linear fastener element row 3 is sewed to a side edge of a fastener tape 7 by sewing yarn 8 so as to finish an ordinary type coil slide fastener or zigzag slide fastener. Alternatively, the linear fastener element row 3 can be sewed on the surface of a folded back portion 25 formed on a side edge of the fastener tape 7 with the sewing yarn 8 so as to finish a hidden type slide fastener.

The end stop 10 is formed by cutting out a rod-like body 14 formed of polyester mono-filament to an appropriate length depending on the size of the slide fastener and this rod-like body 14 is inserted into a coupling space portion 23 existing in the backside of coupling heads 20 of plural fastener elements 4 at an end portion of the linear fastener element row 3. The coupling space portion 23 is a space in which the expanded portion of the coupling head 20 of a mating fastener element 4 invades when the fastener elements 4 opposing of paired fastener stringers 2 engage each other. Because the coupling space portion 23 exists even if the fastener elements 4 are in a coupled state or in a non-coupled state, the rod-like body 14 is inserted using this coupling space portion 23. The rod-like body 14 inserted into the coupling space portion 23 is comprised of an outer end portion 17 located on the side of a distal end of the linear fastener element row 3 and an inner end portion 18 located on an inner side of the linear fastener element row 3 at the side opposite to the outer end portion 17. A fused portion 15 is formed by fusing together the fastener elements 4 of several pitches located on the side of the outer end portion 17 with the rod-like body 14 by ultrasonic welding with an ultrasonic wave processing machine. Also, a non-fused portion 16 is formed without fusing together the fastener elements 4 of several pitches located on the side of the inner end portion 18 with the rod-like body 14 so as to form the end stop 10 for the slider of the top end stop 12 or bottom end stop 11.

The top end side of the end stop 10 is a portion in which a load such as pulling force or twisting force is concentrated on the sewing yarn 8 when the linear fastener element rows 3 are engaged with each other or separated from each other by sliding the slider 27. Therefore, that the non-fused portion 16 of the rod-like body 14 is formed on the top end side of the end stop 10 while the fused portion 15 is formed on the bottom end side is feature of the present invention. Because the sewing yarn 8 near the non-fused portion 16 is never affected by heat upon ultrasonic welding, the sewing yarn 8 is not deteriorated at all and never cut out when the slide fastener is opened/closed. Further, because not so much load is applied to the bottom end side of the end stop 10, even if the sewing yarn 8 is deteriorated by heat upon ultrasonic welding, there is no fear that it may be cut out, and the fastener elements 4 and the rod-like body 14 are fused together by the fused portion 15 so as to form a rigid end stop 10.

First Embodiment

An end stop for a slide fastener according to a first embodiment of the invention shown in FIGS. 1 to 4 will be described. Coil-type fastener elements 5 are formed by winding a mono-filament of polyamide or polyester in the form of a coil and a core thread 9 is inserted into the inside of the coil type fastener elements 5 so as to form the linear fastener element row 3. This linear fastener element rows 3 are mounted on the top face on a side edge of the fastener tape 7 by sewing with the double-ring sewing type sewing yarn 8 with two needles and three threads so as to form a continuous fastener chain 1. In this continuous fastener chain 1, the coil type fastener elements are cut out by a predetermined length so as to form a space in which no coil type fastener elements 5 exist on the top face on the side edge of the fastener tape 7. By cutting out the fastener tape 7 at this space portion, the fastener chain 1 of a unit length is completed.

The rod-like body 14 formed of mono-filament of the same material as the coil-type fastener element 5 is cut to a predetermined length and inserted into the coupling space portion 23 existing in the backside of the coupling head 20 in a state in which the coil-type fastener elements 5 engage each other at an end of the fastener chain 1 and then, fused together by ultrasonic welding with an ultrasonic wave processing machine. In this ultrasonic welding, only the outer end portion 17 of the inserted rod-like body 14, that is, the portion which serves as the lower end portion of the end stop 10 is fused together with the coil type fastener elements 5 and this ultrasonic welding is carried out from the front side of the coil type fastener element 5. Consequently, the slightly dented fused portion 15 is formed in the surface of the element 5. By forming the non-fused portion 16 without fusing the inner end portion 18 of the rod-like body 14, that is, the portion which serves as the upper end portion of the end stop 10 with the coil-type fastener element 5, the bottom end stop 11 is formed so as to complete the end stop 10 for the slider. In this embodiment, the coupling space portion 23 is a space surrounded by the coupling head 20, upper/lower leg portions 21 connected to the top end and bottom end of the coupling head 20 and the core thread 9 inserted through the inside of the elements 5.

Figure 4:
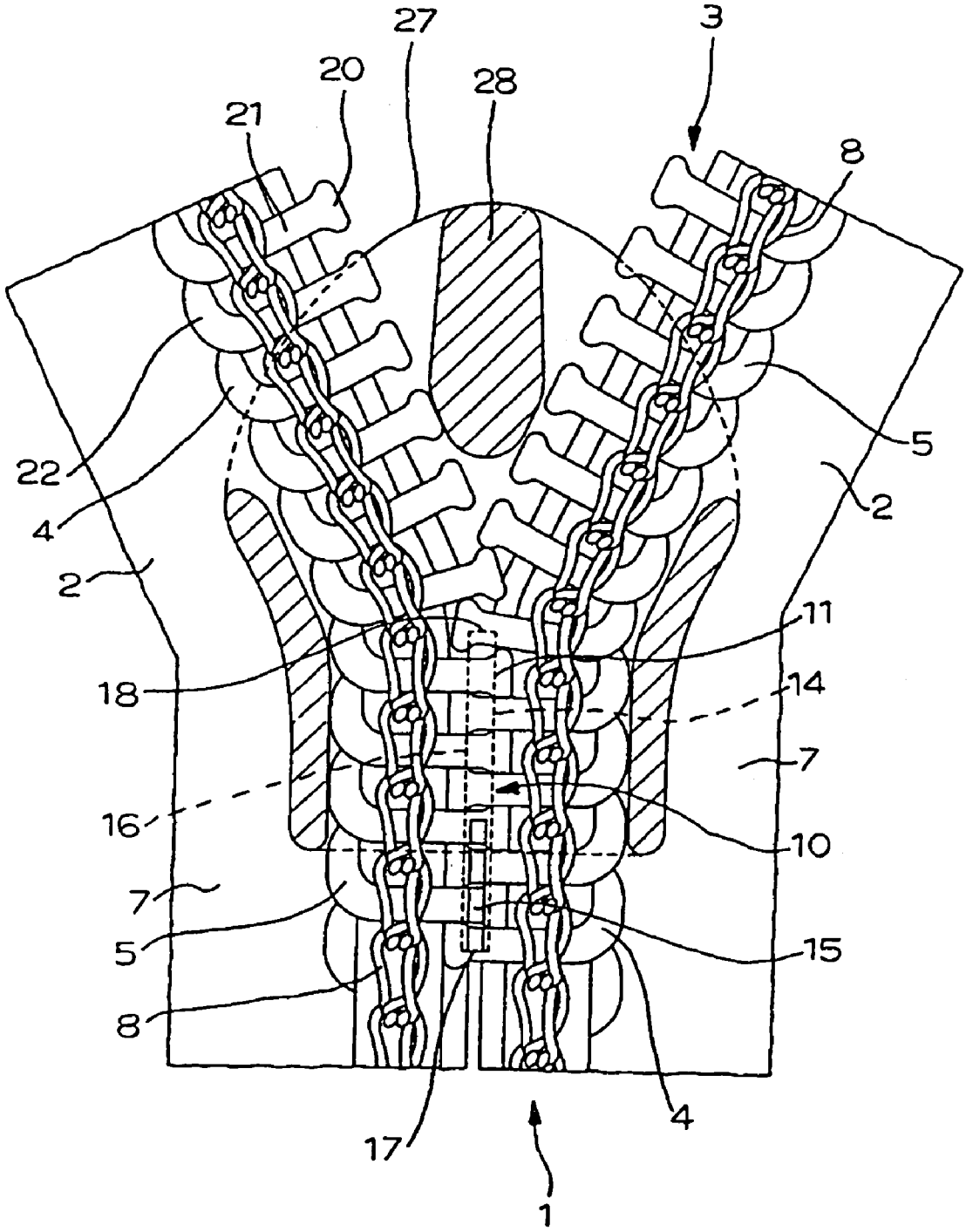
FIG. 4 is a partially broken front view showing the operation of the same slide fastener.

When the fastener chain 1 is opened with the slider 27 as shown in FIG. 4, if the slider 27 arrives at the end stop 10 after the coil-type fastener elements 5 are separated, the sliding of the slider 27 is stopped without further separating the fastener elements 4, because the rod-like body 14 is inserted in the coupling space portion 23 in the plural fastener elements 4 constituting the end stop 10. Because the sewing yarn 8 existing in the non-fused portion 16 is not deteriorated, as it is not heated upon ultrasonic welding, the coil-type fastener elements 5 are fixed firmly. Further, because right and left coil-type fastener elements 5 are fused together with the rod-like body 14 in the fused portion 15 of the end stop 10, a strong and firm bottom end stop 11 is formed. Even if the sewing yarn 8 is more or less heated upon ultrasonic welding, its heating range is very small and hence, the sewing yarn 8 is never cut out by opening/closing the slide fastener.

If exemplifying an example, preferably, the length of the rod-like body 14 of the mono-filament is about 7 mm and the length of the fused portion 15 is about 3 mm while the length of the non-fused portion 16 is about 4 mm.

Though not shown, the end stop having the same configuration can be formed in a woven slide fastener in which the coil-type fastener elements are woven into a side of the fastener tape at the same time when the fastener tape is woven. Further, the end stop having the same configuration can be formed in a knitted slide fastener in which the coil-type fastener elements are knitted into a side of the tape at the same time when the fastener tape is knitted.

Second Embodiment

Figure 5:
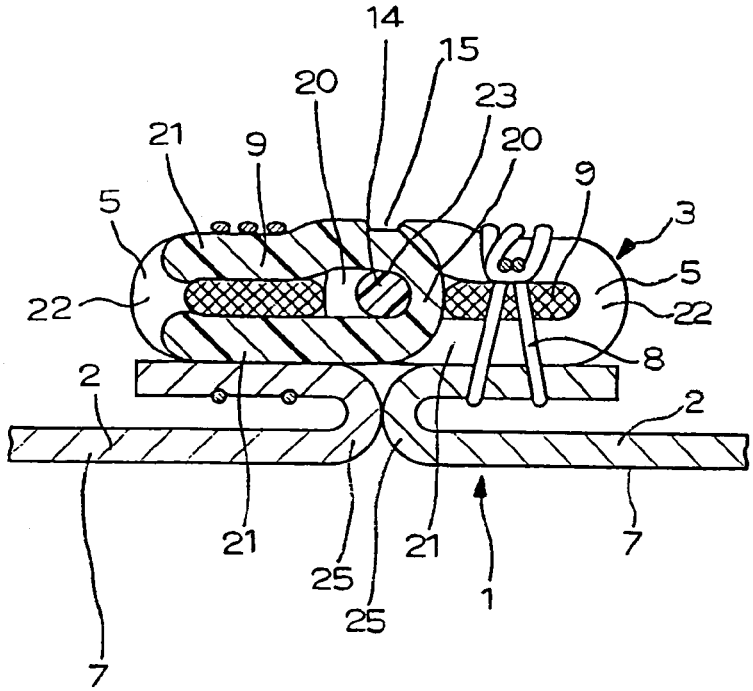
FIG. 5 is a sectional view of a bottom end stop in a hidden type slide fastener.

A slide fastener according to a second embodiment of the invention shown in FIG. 5 concerns a hidden type slide fastener in which the coil-type fastener elements 5 are not visible from the surface of the fastener tape 7. A folded back portion 25 is formed by inverting a side of the fastener tape 7 and the coil-type fastener elements 5 are sewed on the surface of this folded back portion 25 with the sewing yarn 8 through the core thread 9 so as to form a continuous hidden fastener chain 1. By cutting out the coil-type fastener elements 5 in this continuous hidden fastener chain 1 by a specified interval, a space portion is provided and by cutting out the fastener tape 7 at this space portion, the fastener chain 1 of a predetermined length is produced.

The rod-like body 14 of a predetermined length formed of mono-filament of the same material as the coil-type fastener element 5 is inserted into the coupling space portion 23 existing in the backside of the coupling head 20 in a state in which the coupling heads 20 engage at an end of the hidden type fastener chain 1, and by forming the fused portion 15 in which only the outer end portion 17 is fused by ultrasonic welding the rod-like body 14 and the non-fused portion 16 in which the inner end portion 18 is not fused, the bottom end stop 11 of the hidden type fastener chain 1 is formed so as to form the end stop 10 for the slider. The operation and function are the same as described previously. In this embodiment, the coupling space portion 23 is a space surrounded by the coupling head 20, upper/lower leg portions 21 connected to the top end and bottom end of the coupling head 20 and the core thread 9 inserted through the inside of the elements 5.

Third Embodiment

Figure 6:
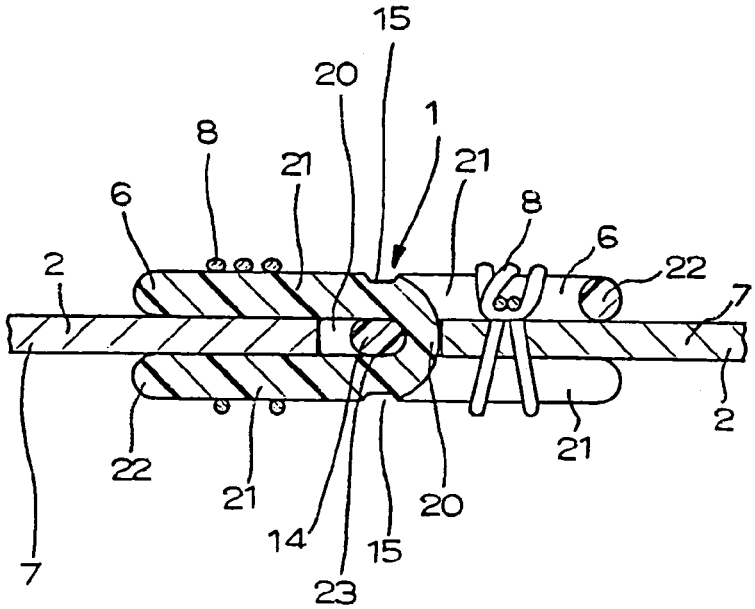
FIG. 6 is a sectional view of a bottom end stop in a zigzag type slide fastener.

A slide fastener for a third embodiment of the invention shown in FIG. 6 is a zigzag type slide fastener using zigzag type fastener elements 6. The zigzag type fastener elements 6 are formed by bending a mono-filament made of resin in a zigzag form, the front and rear sides of a side edge of the fastener tape 7 are sandwiched by the zigzag type fastener elements 6 and the portion between the leg portions 21 in a sandwiched state is mounted by sewing with the sewing yarn 8 so as to form the continuous fastener element 1. In this continuous fastener chain 1, by cutting out the zigzag type fastener elements 6 by a predetermined length, the space portion is provided and then, by cutting out the fastener tape 7 at this space portion, the fastener chain 1 is produced.

Then, the rod-like body 14 of a predetermined length formed of a mono-filament made of the same material as the zigzag fastener element 6 is inserted into the coupling space portion 23 existing in the backside of the coupling head 20 in a state in which right and left zigzag type fastener elements 6 engage at an end of the fastener chain 1, and the side of the outer end portion 17 of this rod-like body 14 is welded with ultrasonic wave from both the front and rear sides of the fastener elements 4 so as to form the slightly dented fused portion 15 in the front and rear faces of the element 6. The inner end portion 18 is not welded so as to form the non-fused portion 16 and then, the end stop 10 is formed as the bottom end stop 11. The operation and function are the same as the example described above. In this embodiment, the coupling space portion 23 is a space surrounded by the coupling head 20, the upper and lower leg portions 21 connected to the top end and bottom end of the coupling head 20 and the side edge of the fastener tape 7 sandwiched by the upper and lower leg portions 21.

It is permissible to form the zigzag type slide fastener by mounting the zigzag type fastener elements on a side edge of a fastener tape with the sewing yarn in an overlapped state although not shown.

Fourth Embodiment

Figure 7:
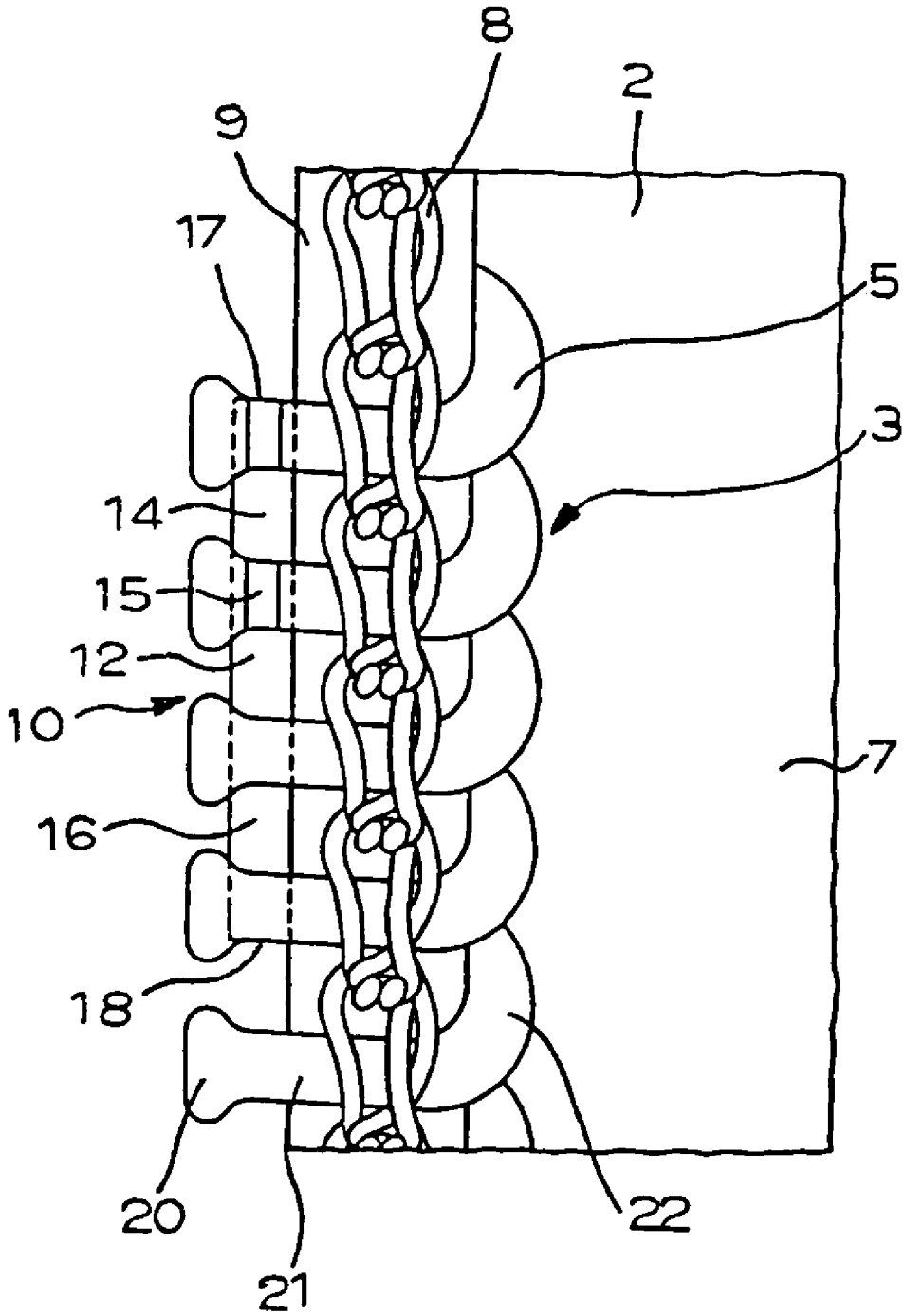
FIG. 7 is a front view showing a top end stop of an ordinary type fastener stringer.

A slide fastener according to a fourth embodiment of the invention shown in FIG. 7 concerns the end stop 10 for the slider as the top end stop 12 formed at an end portion of a coil type fastener stringer 2. For the top end stop 12, the rod-like body 14 of a predetermined length formed of a mono-filament of the same material as the coil-like fastener element 5 is inserted into the coupling space portion 23 existing at a top end portion of the fastener stringer 12, that is, for example, as shown in FIG. 1, in the backside of the coupling head 20 of the coil-type fastener element 5 at the end portion, and the coil-type fastener elements 5 of several pitches on the side of the outer end portion 17 of the rod-like body 14 are fused with the rod-like body 14 by ultrasonic welding so as to form the fused portion 15. The coil type fastener elements 5 of several pitches on the side of the inner end portion 18 are not fused with the rod-like body 14 so as to form the non-fused portion 16.

Although the top end stop 12 may be provided on both the right and left fastener stringers 2, it is permissible to provide it on the fastener stringer 2 of one side. The top end stop 12 is formed such that the coupling head 20 of the mating fastener element 4 to be meshed with is incapable of invading in between the coupling heads 20 on the end stop 10 side. Because in the non-fusing portion 16 of the top end stop 12 completed, the sewing yarn 8 is not deteriorated as it is not heated, the coil-type fastener elements 5 are fixed firmly. In addition, in the fused portion 15, the coil type fastener elements 5 and the rod-like body 14 are fused and integrated so as to finish a strong and rigid top end stop 12. This top end stop 12 is available effectively as the end stop 10 for the slider.

Fifth Embodiment

Figure 8:
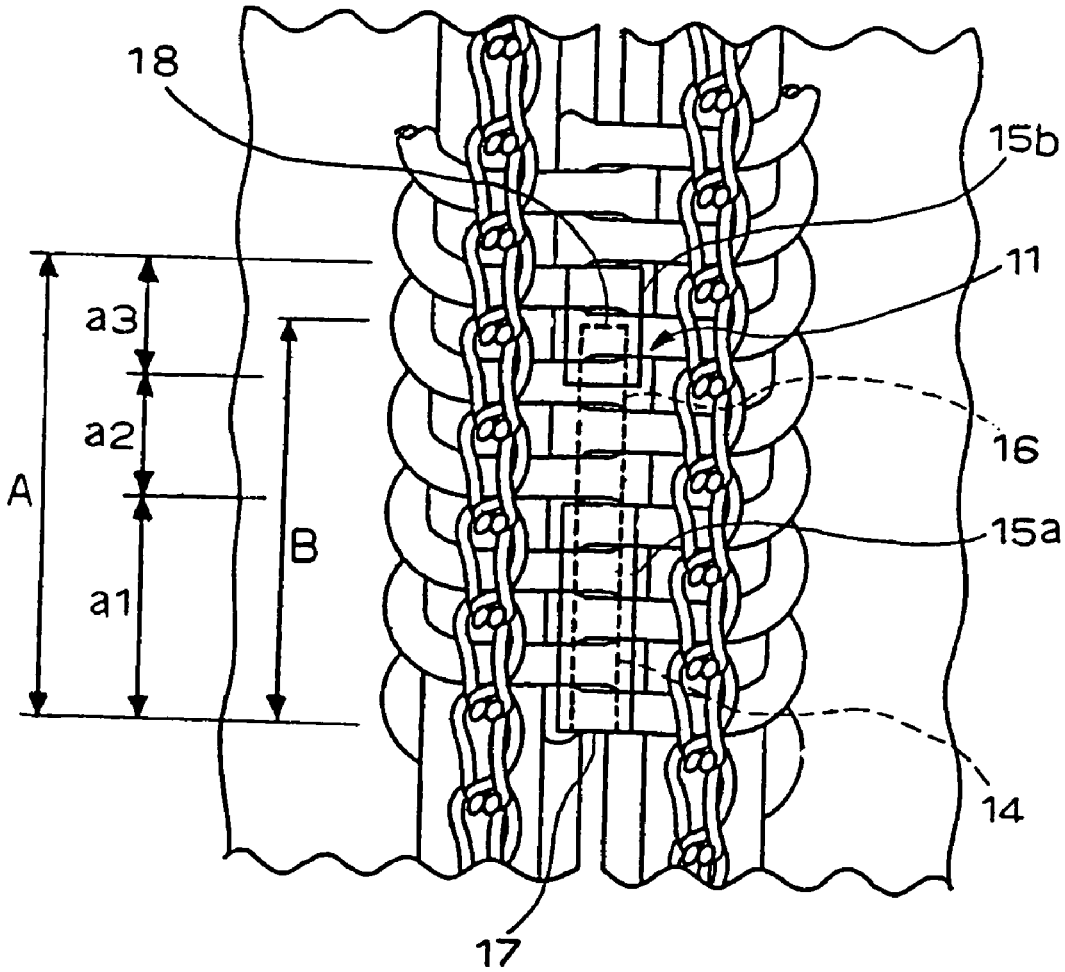
FIG. 8 is a front view of a bottom end stop in an ordinary type fastener stringer.
Figure 9:
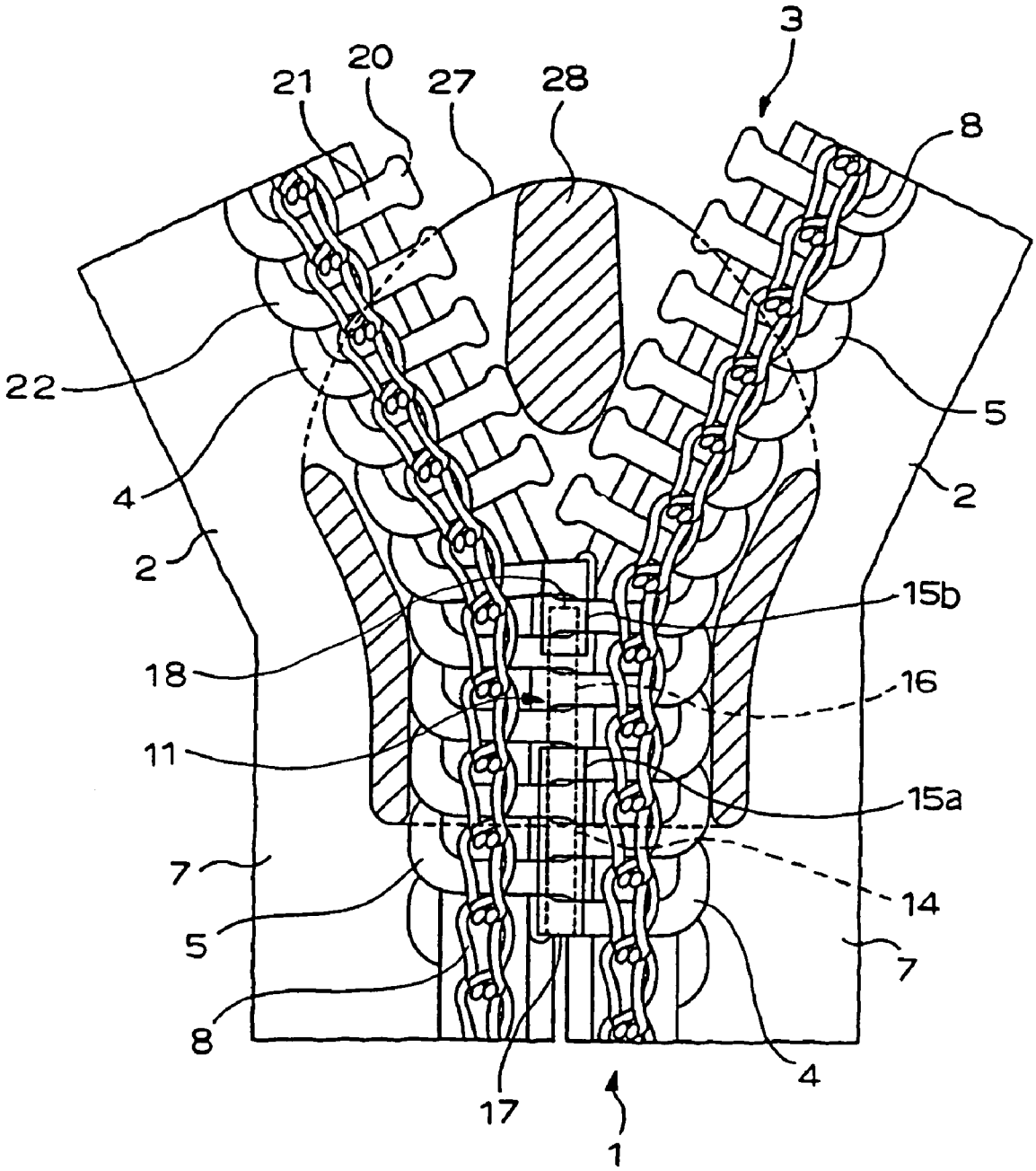
FIG. 9 is a front view of a bottom end stop in an ordinary type slide fastener.
Figure 10:
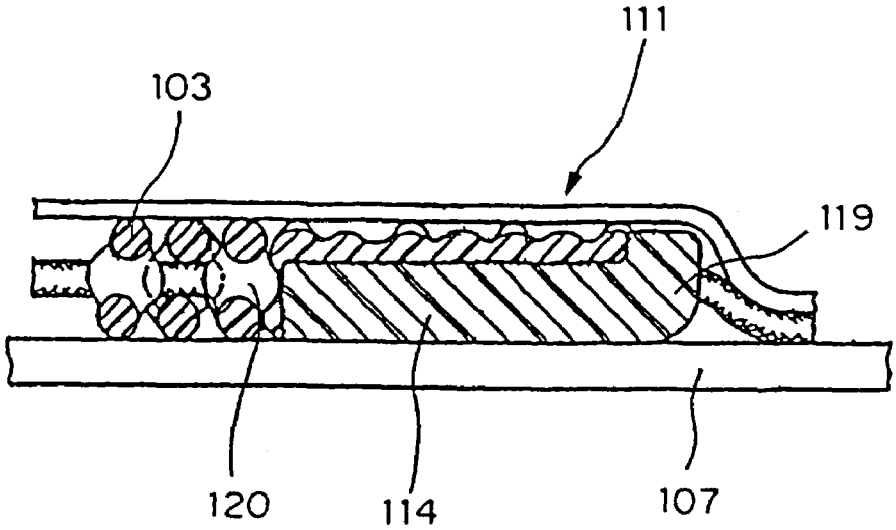
FIG. 10 PRIOR ART
FIG. 10 is a sectional view of a bottom end stop of a well known slide fastener.
Figure 11:
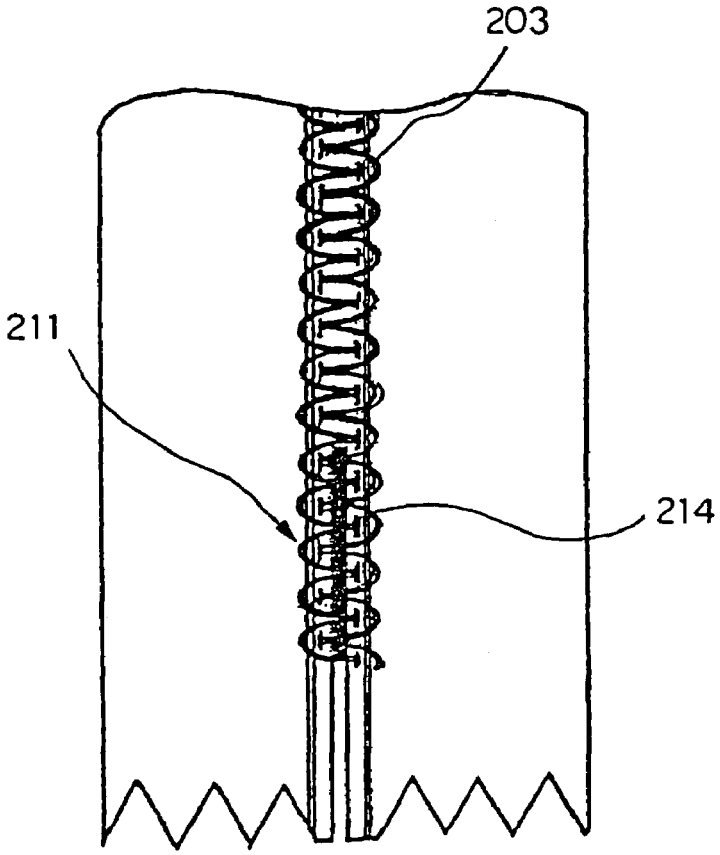
FIG. 11 PRIOR ART
FIG. 11 is a front view of a bottom end stop of another well known slide fastener.

FIG. 8 and FIG. 9 show the fifth embodiment of this invention.

In this embodiment, in the bottom end stop 11, several coil type fastener elements 5 on the outer end portion 17 side of the rod-like body 14, the coil type fastener elements 5 being of plural coil type fastener elements 5 in which the rod-like body 14 is inserted, are fused with the rod-like body 14 so as to form the first fused portion 15*a*.

Also, in the bottom end stop 11, the coil type fastener elements 5 in which the rod-like body 14 are inserted is fused with the inner end portion 18 of the rod-like body 14 so as to form the second fused portion 15*b*. As shown in FIG. 9, the second fused portion 15*b* prevents the inner end portion 18 of the rod-like body 14 from escaping from the inside of the coil type fastener elements 5 at the time when the slider 27 moves to the location where the slider 27 contacts with the bottom end stop 11, right and left coil type fastener elements 5 are separated, and the coil type fastener elements 5 in the inner end portion 18 side of the bottom end stop 11 are pushed and opened in the right and left directions. With this feature, it is possible to engage with right and left coil type fastener elements 5 each other smoothly when the slider 27 is moved to the direction away from the bottom end stop 11.

Meanwhile, the second fused portion 15*b* has the fusing range which includes the portion in which the coil type fastener elements 5 in which the rod-like body 14 is not inserted is fused with the coil type fastener elements 5 in which the rod-like body 14 is inserted. That is, the entire length of bottom end stop 11 is longer than that of rod-like body 14.

Since the second fused portion 15*b* is set the coil type fastener elements 5, in which rod-like body 14 is not inserted, adjacent to the coil type fastener elements 5 in which the rod-like body 14 is inserted in the fusing range, the inner end portion 18 of the rod-like body 14 can be fused with the coil type fastener elements 5 surely within the range of the second fused portion 15*b*, even if the length of the rod-like body 14 may be different and the rod-like body 14 longer than the predetermined length is inserted into the coil type fastener elements 5.

Also, between the first fused portion 15*a* and the second fused portion 15*b*, the non-fused portion 16 is provided in which coil type fastener elements 5 is not fused with rod-like body 14, which is inserted in the coil type fastener elements 5.

Due to providing the non-fused portion 16 in the bottom end stop 11, the rod-like body 14 is not fused with the coil type fastener elements 5 too tightly, and the fused rod-like body 14 and the coil type fastener elements 5 do not become fragile and are not damaged. Further, since the bottom end stop 11 does not become rigid, even if the slider 27 moves toward the bottom end stop 11 and butts the bottom end stop 11, the non-fused portion 16 bends slightly and changes its shape so that it alleviates the impact strength and prevents the damage of bottom end stop 11.

Here is the length relation between the first fused portion 15*a*, the second fused portion 15*b* and the length of non-fused portion 16 in the longitudinal direction of the rod-like body 14. The first fused portion 15*a* is the longest, and the second fused portion 15*b* is as long as the non-fused portion 16. However, in the portion of the coil type fastener elements 5 in which the rod-like body 14 is inserted, the first fused portion 15*a* is the longest, the non-fused portion 16 is in the second longest and the second fused portion 15*b* is the shortest.

The specific example will be described. In FIG. 8, the length B of the rod-like body 14 is 7 mm, and the length A of the entire fused portion 15 is 8 mm. The length a1 of the first fused portion 15*a* is 4 mm, the length a3 of the second fused portion 15*b* is 2 mm, and the length a2 of non-fused portion 16 is 2 mm. In the length of 2 mm, the second fused portion 15*b* is fused with the rod-like body 14 1 mm in length.

The length relation of each portion is not limited to above mentioned lengths, and for example, it is permissible that the lengths of the first fused portion 15*a* and the second fused portion 15*b* will be same and the length of the non-fused portion 16 is longer than the first fused portion 15*a* and the second fused portion 15*b* respectively, and the non-fused portion 16 is permissible to have the same length of the sum of the lengths of the first fused portion 15*a* and the second fused portion 15*b*.

The specific example will be described in that case. The length B of the rod-like body 14 is 7 mm, the length A of the entire fused portion 15 is 8 mm, the length a1 of the first fused portion 15*a* is 2 mm, the length a3 of the second fused portion 15*b* is 2 mm, and the length a2 of the non-fused portion 16 is 4 mm. In the length of 2 mm, the second fused portion 15*b* is fused with the rod-like body 14 1 mm in length.

With above-mentioned example, the length of the entire fused portion is longer than that of the non-fused portion 16, and the length of the non-fused portion 16 is in the range of less than the sum of the lengths of the first fused portion 15*a* and the second fused portion 15*b*. With this feature, the fusing strength between the rod-like body 14 and the coil type fastener elements 5 is secured.

It is preferable that the fused portion 15, 15*a* should be made longest, in which the outer end portion 17 of the rod-like body 14 and the linear fastener elements 4 are fused with. With this feature, the fused portion 15, 15*a* is on the location in which the fused portion 15, 15*a* is lest likely to be loaded, when the slider 27 contact with the bottom end stop 11 and the linear fastener elements 4 adjacent to the bottom end stop 11 is pushed and opened, so that the damage of bottom end stop 11 can be prevented.

In addition, the dimensional relation between the rod-like body 14, the first fused portion 15*a* and the second fused portion 15*b* in the width directions thereof is that each width of the first fused portion 15*a* and the second fused portion 15*b* is wider than that of the rod-like body 14, and the width of rod-like body 14 is fit within each width of the first fused portion 15*a* and the second fused portion 15*b*.

The specific example will be described. The diameter, that is the width of the rod-like body 14 is 6 mm, while each width of the first fused portion 15*a* and the second fused portion 15*b* is 10 mm.

Since the rod-like body 14 is pushed and changed its shape at the time of fusing with the coil type fastener elements 5, so that its width is wider than that of above mentioned dimension, the rod-like body 14 can be fused with the coil type fastener elements 5 firmly in the wide range in respective fused portions 15*a*, 15*b*.

In the end stop of the slide fastener of the present invention, the coil type or the zigzag type linear fastener elements, both of which being formed of a mono-filament of polyamide or polyester are mounted on a side edge of the fastener tape so as to complete an ordinary type or hidden type slide fastener. In the top end stop and bottom end stop of this slide fastener, a sewing yarn for fastening the fastener elements onto a fastener tape is never cut out due to a load by sliding of the slider and the end portion of the end stop is integrated firmly by fusion. Further, because the produced end stop does not use any metal and is free of any burr on its surface, particularly, this is suitable and can be employed for a slide fastener for clothing.

What is claimed is:

1. An end stop for a slide fastener, wherein a linear fastener element row of synthetic resin is mounted on a side edge of a fastener tape; a rod-like body of synthetic resin is insened into a coupling space portion located in an inside of coupling heads in plural fastener elements located at an end of the fastener element row; first and second fused portions are provided by fusing several fastener elements of the plural fastener elements in which the rod-like body is inserted with the rod-like body; and a non-fused portion is formed without fusing the fastener elements of the plural fastener elements in which the rod-like body is inserted except the fastener elements fused with the rod-like body in the first and second fused portions so as to form the end stop, and wherein the first fused portion is provided on an outer end portion of the rod-like body, the second fused portion is provided on an inner end portion of the rod-like body, and the non-fused portion is provided between the first fused portion and the second fused portion.

2. The end stop for the slide fastener according to claim 1, wherein a length of the second fused portion in a longitudinal direction of the rod-like body is in a range of half or less of the length of the rod-like body.

3. The end stop for the slide fastener according to claim 1, wherein a length of the first fused portion in a longitudinal direction of the rod-like body is longer than the length of the second fused portion.

4. The end stop for the slide fastener according to claim 1, wherein a length of the non-fused portion in a longitudinal direction of the rod-like body is in a range of less than a sum of the length of the first fused portion and the length of the second fused portion.

5. The end stop for the slide fastener according to claim 1, wherein a length of the first fused portion in a longitudinal direction of the rod-like body is longer than the length of the second fused portion and the length of the non-fused portion.

6. The end stop for the slide fastener according to claim 1, wherein the rod-like body is inserted into the linear fastener element row in a separated state so as to form a top end stop.

7. The end stop for the slide fastener according to claim 1, wherein the rod-like body is inserted into the linear fastener element row in a coupled state so as to form a bottom end stop.

8. The end stop for the slide fastener according to claim 1, wherein the linear fastener element row is disposed on the side edge of the fastener tape and sewed with a sewing yarn.

9. The end stop far the slide fastener according to claim 1, wherein the linear fastener element raw is formed of coil type fastener elements.

10. The end stop for the slide fastener according to claim 1, wherein the linear fastener element row is formed of zigzag type fastener elements.

* * * * *